US005522295A

United States Patent [19]

Chun

[11] Patent Number: 5,522,295

[45] Date of Patent: Jun. 4, 1996

[54] REAR ADDRESS PUNCH WITH TURRET FRAME

[75] Inventor: Victor L. Chun, Charlotte, N.C.

[73] Assignee: Murata Machinery, Ltd., Kyoto, Japan

[21] Appl. No.: 205,653

[22] Filed: Mar. 4, 1994

[51] Int. Cl.[6] ..... B21D 28/36; B26F 1/04

[52] U.S. Cl. ..... 83/552; 29/36; 72/442

[58] Field of Search ..... 83/552, 563; 29/33 J, 29/36, 40; 72/442; 483/28, 29

[56] References Cited

U.S. PATENT DOCUMENTS

| | | | |
|---|---|---|---|
| 2,701,017 | 2/1955 | Wiedemann | 83/552 X |
| 3,938,416 | 2/1976 | Beauplat | 83/552 |
| 4,907,480 | 3/1990 | Kuroyone | 83/552 |
| 5,346,454 | 9/1994 | Hayashi | 83/552 X |

*Primary Examiner*—Rinaldi I. Rada
*Assistant Examiner*—Raymond D. Woods
*Attorney, Agent, or Firm*—John R. Benefiel

[57] ABSTRACT

A punch press having a rear address configuration is described in which a forward facing carriage cross slide is mounted within the throat space of a punch press main frame and an auxiliary turret frame mounts the punch and die rotary turrets separately from the main punch frame, avoiding the need to prevent turret misalignment by main frame deflection during punching. Separate turret modules also allow matching different turret configurations to various punch press configurations. A turret module having different diameter independently driven upper and lower turrets is also disclosed, allowing a greater number of dies than punches to be stored to allow any several dies to be mated with a particular punch for proper punching with various materials.

6 Claims, 2 Drawing Sheets

REAR ADDRESS PUNCH WITH TURRET FRAME

BACKGROUND OF THE INVENTION

1. Field of the Invention

This invention concerns punch presses equipped with rotary turrets for holding punches and dies in which workpieces are moved by a carriage and cross slide located within the throat of the press, such presses often referred to as "rear address" machines.

2. Description of the Prior Art

Punch presses have long been used for forming holes in sheet material. Modern equipment uses a carriage supporting a cross slide having workpiece engaging grippers to automatically move a sheet workpiece so as to bring particular locations on the sheet to a punching station. In turret punch presses, a number of punches and dies are mounted in respective upper and lower turrets which are rotated to bring a selected punch and die combination to the punching station.

The punch press typically has a C-shaped frame, with the punch ram mounted to the front of an upper portion of the frame so that the sheet workpiece can be moved into the opening formed by the C-shaped frame configuration for punching holes in the regions remote from the sheet edge advanced into the opening.

In many presses, referred to as front address machines, the carriage and cross slide are mounted on an extension of the base portion of the frame located to the front of the machine, the carriage moving towards the punching station from its furthest retracted position. This limits the sheet size due to the constraint imposed by the limited distances from the retracted carriages to the punching location and from the punching station to the back of the press frame throat.

As an alternative, some punch presses utilize so called "rear address" configurations, in which the carriage and cross slide, as well as a fixed table are located within the press frame throat. The carriage moves out along a Y-axis from a retracted position adjacent the back of the throat opening towards the punch station. The workpiece is thus free to extend out from the press frame and may be oversized in the Y-axis direction, and is more easily turned for carrying out punching operations on the previously unreachable section.

This rear address punch press configuration often involves a deeper and wider throat opening to accommodate the carriage, cross slide and table.

The ram is powered by a ram drive means such as mechanical slider crank mechanism or a hydraulic drive capable of generating many tons of force. Such force levels requires a heavy frame construction to avoid excessive deflection for the rear address machines.

Heretofore, the upper and lower turrets have been mounted aligned within the press frame. The upper turret is mounted on the upper portion of the frame C-shape. This increases the need for a rigid frame, as the upper turret tends to be misaligned by deflection of the frame.

The large size frame required increases manufacturing and shipping costs.

The mounting of the turrets in the frame opening also restricts the diameter of the turrets, which in turn limits the number of tools which can be stored.

Another disadvantage is that it is more difficult for manufacturers to offer presses having differing turret sizes, since the turrets are integrated into the press, and different press models would have to be produced to offer different turret sizes.

U.S. Pat. No. 3,938,416 issued on Feb. 17, 1976, for "Punching or Nibbling Presses Having a Turret" describes a punch press incorporating a separate frame for a turret assembly. In that arrangement, a workpiece supporting circular fixed table is associated with the separate turret frame, and is transported with movable tables which swing about the fixed table perimeter.

Thus, that press configuration does not have improved capabilities in regard to the punch press of the state of the art, and indeed is more limited in some respects as to its sheet handling ability.

Another problem with the turret equipped punch press is that several dies must often be provided for each punch, since different die clearances are required for various materials. Since equal number of storage locations are in each turret, this limits the number of such configurations, necessitating increased tool changing and, adversely affecting productivity.

Since turrets are driven synchronously, a plurality of duplicate punches are needed, one for each different die clearance, increasing tooling costs and the time to set up tooling.

An object of the present invention is to provide an improved configuration of a punch press equipped with tool storing turrets to lessen or avoid the above-described problems.

SUMMARY OF THE INVENTION

The above object, as well as other objects which will become apparent upon a reading of the following specification and claims is achieved by providing a rear address main punch press frame in which a carriage, cross slide and table are mounted within the main press frame.

An auxiliary turret frame is juxtaposed to the main press frame, the auxiliary turret frame also C-shaped, and facing the main press frame with the upper turret rotatably mounted to the upper portion, the lower turret rotatably mounted to the lower or base portion of the auxiliary turret frame.

An auxiliary frame throat opening is aligned with and open to the main press frame throat opening to receive the workpiece projecting from the rear address carriage and accommodating Y-axis movement of the outer edge of the workpiece.

The auxiliary turret frame may be separated from the main press frame but is positioned so that the perimeter of the turrets protrudes into the main press frame opening and the diameter whereat the ring of punches and dies are arranged, rotates through the punching station, allowing the punches and dies held in the turrets to each be selectively brought into operative position.

The upper and lower turret drive mechanisms are also mounted on the auxiliary turret frame so that the turrets, auxiliary frame, and turret drives form a separate assembly or unit.

The mounting of the turrets in the auxiliary turret frame eliminates the size constraint imposed by the limitations of the press frame throat opening depth, so that the turrets can be made of any reasonable size to hold greater numbers of punches and dies.

Since the turrets are not supported on the press frame members, deflection of the press frame members under the heavy loads imposed by the ram generated punching forces does not affect the turret alignment which thus remain in alignment during punching so that the greater throat size occasioned by the rear address configuration can easily be provided without necessitating an extremely rigid frame construction. Indeed, the main press frame can be of lighter construction as it does not have to hold the turrets in alignment during punching.

The fact that the turrets, auxiliary frame, and turret drive mechanism form a separate unit allows turret sets of various configurations to be matched to and of a variety of basic press models allowing increased availability of various punch press turret size combinations.

The separate auxiliary turret frame also allows the Y-axis dimension to be enlarged to accommodate punching of oversized sheets in the Y-axis direction.

The reduction in structural requirements of the punch press frame and the separate manufacture of the two frames reduces costs and makes shipping easier.

According to another aspect of the present invention, the lower turret is made of larger diameter and with its rotational axis offset from that of the upper turret so that the perimeters of the upper and lower turrets coincide at the punching station. The upper and lower turrets are independently driven so that a single punch in the upper turret can be matched with several different dies in the cover turret. Thus, a larger number of dies can be stored to allow multiple dies for each punch configuration, eliminating the need for duplicate punches.

DETAILED DESCRIPTION

In the following detailed description certain specific terminology will be employed for the sake of clarity and a particular embodiment described in accordance with the requirements of 35 USC 112, but it is to be understood that the same is not intended to be limiting inasmuch as the invention is capable of taking many forms and variations within the scope of the appended claims.

Figure 1:
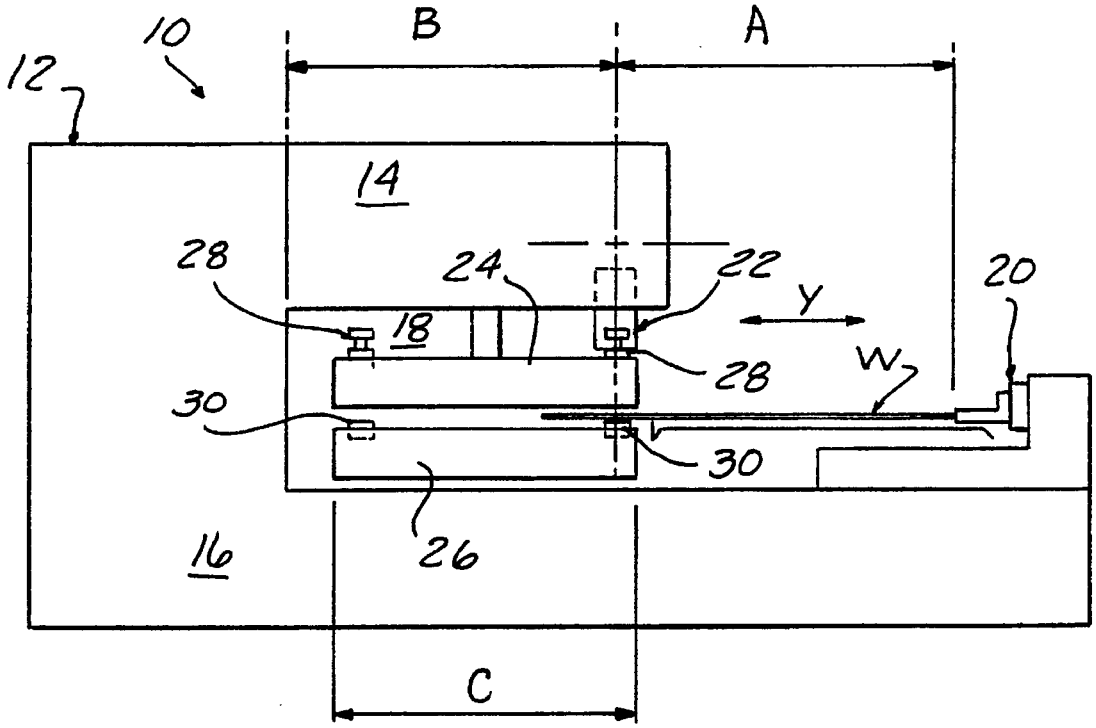
FIG. 1 is a side elevational diagrammatic representation of a punch press of conventional construction.

Referring to FIG. 1, the prior art configuration of a punch press 10 is depicted, which includes a C-shaped press frame 12, having an upper portion 14 and a lower or base portion 16. The upper and lower portions 14, 16 are connected together at the rear and are vertically spaced to define an open throat space 18, which is adapted to receive a sheet material workpiece W projecting rearwardly from the grippers of a front address cross slide carriage assembly 20. The cross slide gripper assembly 20 is under program control and positions the workpiece W so as to bring a particular location on the workpiece beneath the punch ram 22 by rearward Y-axis movements towards the punch ram 22. The punch ram 22 is located at a punching station at the forward end of the upper portion 14 of the punch frame 12. The ram 22 is driven by a suitable mechanical, hydraulic or other ram drive means (not shown).

An upper turret 24 and a lower turret 26 are each rotatably mounted in the space 18, the upper turret 24 mounting a series of punches 28 received in pockets arranged about its perimeter, the lower turret 26 mounting mating dies 30 received in pockets also arranged about its perimeter.

A drive mechanism (not shown) under program control rotates the turrets 24, 26 to bring a selected punch and die to the punch station, the selected punch 28 being coupled to the ram 22 as the upper turret 24 rotates into the station by a tee slot in the ram 22 or by other well known arrangements.

The press frame upper portion 14 tends to deflect upwardly as a punch 28 is driven through a workpiece W by the ram 22, which tends to misalign the respective turret rotation axes. The frame 12 must be relatively massive to avoid excessive misalignments.

The punching range A is usually slightly less than the depth B of space 18. The turret diameter C is limited by the depth B.

The total size of the workpiece in the Y direction is limited by the lesser of dimensions A or B.

Figure 2:
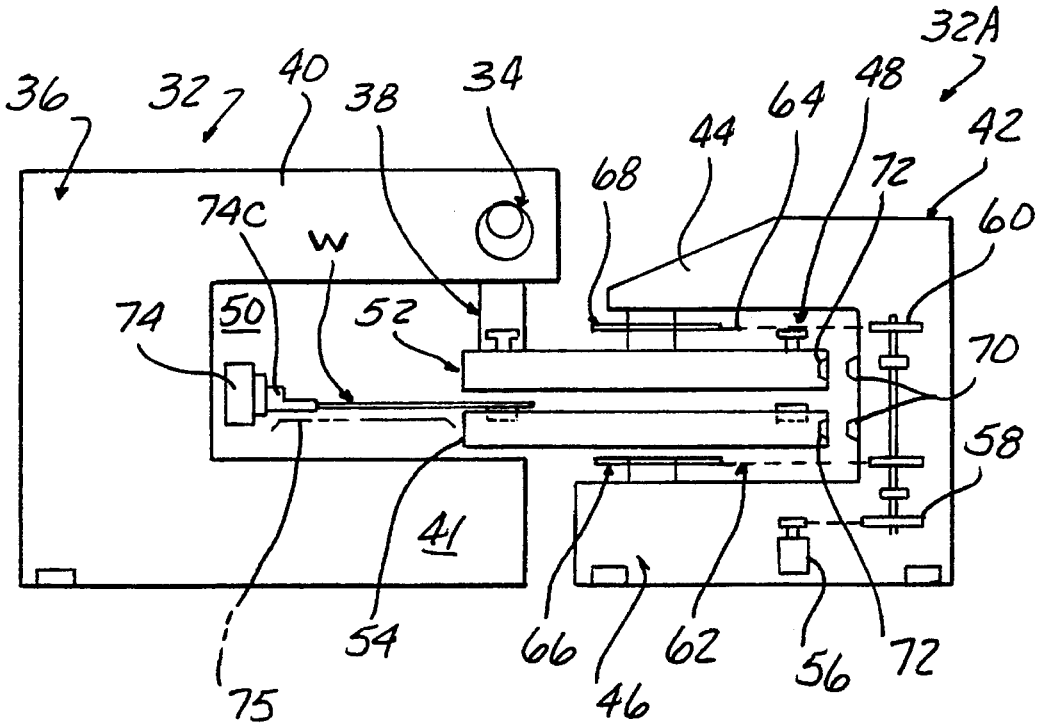
FIG. 2 is a side elevational diagrammatic representation of a punch press configuration according to the present invention.

Referring to FIG. 2, this drawing shows the improved configuration of the punch press according to the invention, including a punch press module 32. The punch press module 32 includes a C-shaped main punch press frame 36, having a ram 38 mounted at the forward end of an upper frame portion 40, in similar fashion as the prior art configuration, with a ram actuator 34 depicted schematically as an eccentric mounted within the frame portion 40.

Figure 3:
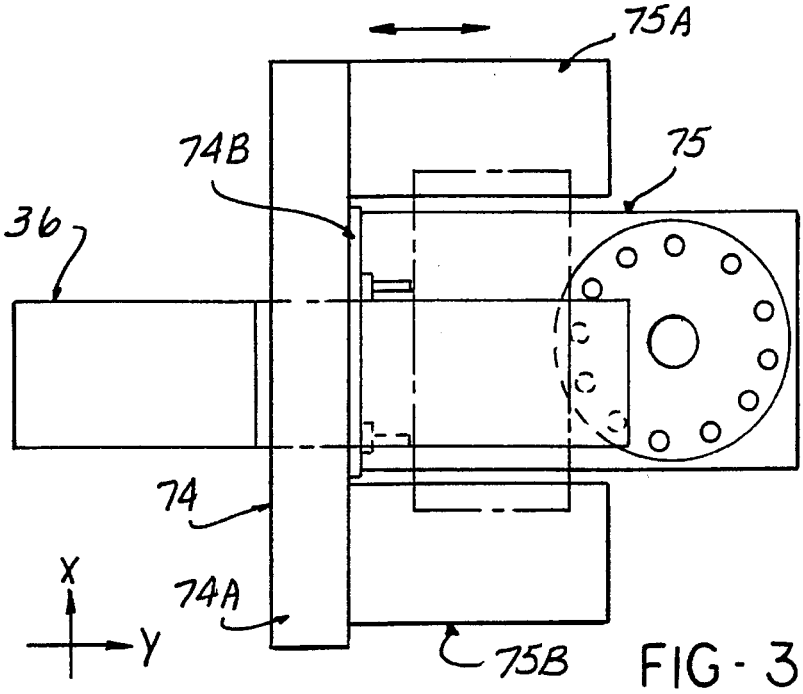
FIG. 3 is a plan view of the punch press shown in FIG. 2.

A rear address configuration is formed by the mounting of a forward facing carriage cross slide assembly 74 at the back of the throat space 50 defined between the upper and lower main press frame portions 40, 41 (FIG. 3). A carriage 74A included in the assembly 74 has a pair of movable table portions 75A, 75B extending forwardly therefrom on each side of a cross slide 74B attached to the central forward side of the carriage 74A. A fixed table 75 is also mounted within the main press space 50, extending around upper and lower turrets 52, 54, to support a workpiece W as it is moved along the Y-axis held in the grippers 74C, with the ends on movable tables 75A, 75B.

A separate auxiliary turret module 32A is provided having a turret frame 42 also C-shaped, having an upper portion 44 and a lower or base portion 46 defining an open throat space 48 facing the space 50 of the main press frame.

The auxiliary turret frame 42 rotatably mounts the upper turret 52, supported on the upper frame portion 44, and the lower turret 54 supported on the lower or base frame portion 46.

The main press frame 36 and auxiliary turret frame 42 while separated, are properly aligned with each other during installation so that the turret tool holder pockets on both the upper turret and lower turret 54 rotate into registry with the ram 38 at the punch station as the turrets are driven by a turret drive motor 56 and suitable transmission elements, such as sprockets 58 and 60, chains 62, 64 and turret sprockets 66, 68.

Registration pin and bushings 70, 72 enable particular tool pockets to be located in accurate registry for mating of a punch 48 with the ram 38 and punching of the workpiece W driven by the carriage-gripper mechanism 74 to present a particular location for punching, all under the control of the system program controller in the well known manner.

It can be seen that the turrets 52, 54 are no longer affected by the deflection induced by the punching tonnages exerted since they are supported on the separate frame 42.

The rear address configuration combined with the separated turret frame 42 enables handling increased sheet sizes in the Y-axis direction.

The diameter of the turrets 52, 54 is no longer limited by the depth of the opening 50 of the main press frame 36, and increased sheet sizes along the Y-axis are possible as the workpiece W can extend between the turrets 52, 54.

The throat depth of the main press frame 36 opening 50 is increased to accommodate the presence of the forward facing carriage 74A, cross slide 74B and gripper mechanism 74C but the elimination of the need to secure the alignment of the turrets during punching allows the main frame to accommodate the increased throat depth without requiring a reinforced rigid construction. Turning of the workpiece W to reverse the same will enable completely punching across the Y-axis dimension of the workpiece.

Thus, the main press frame 36 can be of lighter construction and less bulky, reducing manufacturing and shipping costs.

The separate press turret modules also allow differing combinations of press turret configuration to be created, assembled at the installation of the equipment.

Figure 4:
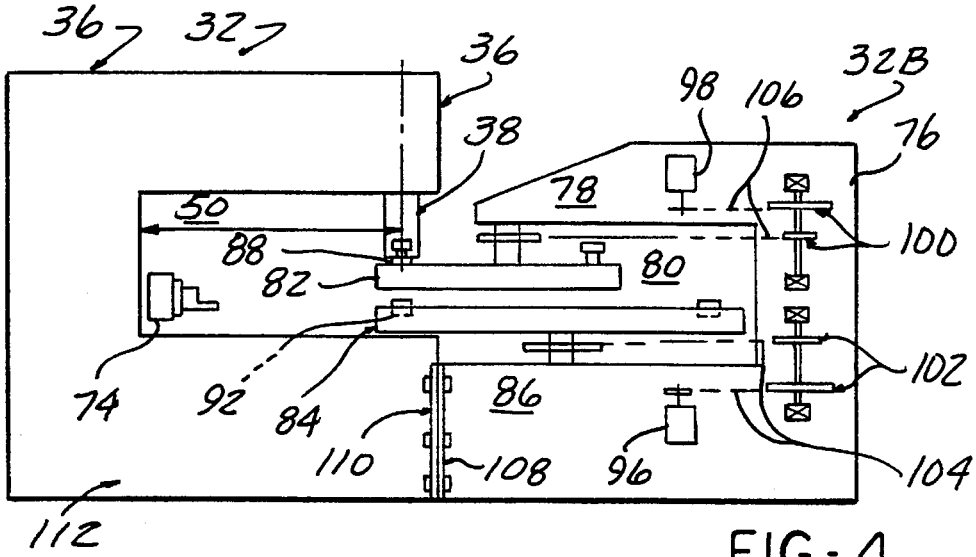
FIG. 4 is a side elevational diagrammatic representation of an alternative punch press configuration according to the present invention.

Referring to FIG. 4, another configuration of the turret module 32B is shown, also comprised of a separate auxiliary turret frame 76, also C-shaped with an opening facing the opening 50 of the main press frame 36 of the press module 32, which may be identical to that of FIG. 2.

The turret frame 76 has an upper portion 78 overhanging space 80, with an upper turret 82 rotatably mounted to the under portion thereof suspended within the space 80.

A lower turret 84 is rotatably mounted to the lower or base portion 86 of the turret frame 76.

Figure 5:
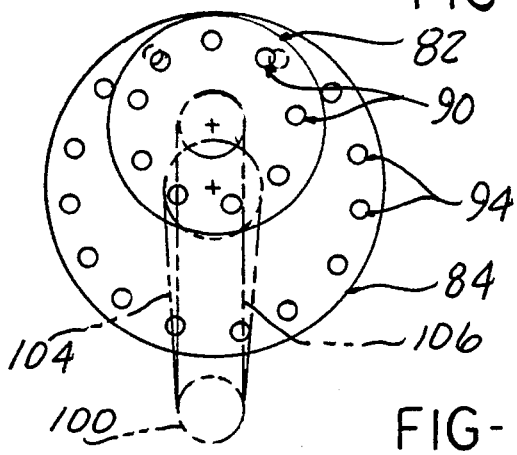
FIG. 5 is a plan diagrammatic view of the upper and lower turrets incorporated in the embodiment shown in FIG. 4.

As seen in FIG. 5, the upper turret 82, which has the punches 88 stored in pockets 90 arrayed about the perimeter, is of substantially smaller diameter than the lower turret 84, which has dies 92 stored in pockets 94 arrayed about the perimeter. Thus, many more dies 92 can be stored, with several dies 92 available for at least some of the punches 88.

The axes of rotation of the upper turret 82 and lower turret 84 are offset, so that the respective pockets 90, 94 are aligned at the punch station directly beneath the ram 38.

This arrangement necessitates independent drives for the upper turret 82 and lower turret 84, comprised of separate drive motors 96, 98 and associated transmission sprockets 100, 102 and chains 104, 106.

This enables each turret to be rotated to bring any particular punch and die combination to the punching station.

Thus, the cost of duplicate punches to be used with each of a series of different clearance dies is saved, as well as time for setting up the tooling. Also, the dies are more easily accessed due to the smaller diameter upper turret.

This configuration may also be employed in a conventional punch press, but is preferably used with the rear address configuration with the auxiliary turret frame 76 as shown.

The main press frame 36 can be mounted to the auxiliary turret frame 76 as shown with abutting surfaces 108, 110 on the base or lower portions 112, 86 of the respective frames secured with bolts, as an aid in establishing the proper alignment of the punches, dies with respect to the axes of the gripper carriage 74. Separate connector pieces (not shown), may also be employed for this purpose, or these structures may be separately set up as shown in FIG. 2.

I claim:

1. A punch press having a rear address configuration comprising:

a C-shaped main punch press frame having a generally horizontally extending upper portion and a generally horizontally extending base portion joined together at one end and defining an intervening open throat space therebetween open to a front end of said frame, said throat space having a front and a rear region;

a punch ram mounted to a free end of said upper portion and adapted to be stroked along a vertical axis into said intervening open space;

a carriage cross slide assembly located within said main punch press throat space so as to be able to be retracted to said rear region of said throat space and move along a Y-axis toward the front end of said frame;

a C-shaped auxiliary frame positioned adjacent to said main press frame and having a generally horizontally extending upper portion and a generally horizontally extending base portion joined at one end with an intervening open space therebetween, said respective intervening open spaces of said main press frame and auxiliary frame opening towards each other;

an upper turret mounted to an underside of said auxiliary frame upper portion to be disposed within said intervening open space of said auxiliary frame for rotating about an axis, said upper turret having a perimeter protruding into said intervening open space of said main press frame, said upper turret having a series of punch receiving pockets arrayed about the perimeter thereof each pocket able to be rotated beneath said punch ram as said upper turret is rotated beneath said punch ram to bring successive portions thereof within said intervening open space of said main press frame;

a lower turret mounted to said auxiliary frame base portion disposed within said intervening open space of said auxiliary frame for rotation about an axis, said lower turret also having a perimeter protruding into said intervening open space of said main press frame, said lower turret having a series of die receiving pockets arrayed about the perimeter thereof, each die receiving pocket able to be rotated beneath said punch ram as said lower turret is rotated to bring successive portions thereof within said intervening open space of said main press frame; and, turret drive means for rotating each of said upper and lower turrets; and, a fixed table within said main frame throat space and extending forwardly into said auxiliary frame intervening open space;

said upper turret is of smaller diameter than said lower turret and wherein said axes of rotation of said upper and lower turrets are offset so that the perimeter of each turret coincides under said punch ram, said lower turret having a substantially larger number of pockets than said upper turret, said pockets moving into alignment beneath said punch ram.

2. The punch press according to claim 1 wherein said turret drive means is supported on said auxiliary frame.

3. The punch press according to claim 1 wherein said main frame base portion and said auxiliary frame base portion are abutted against each other and secured together.

4. The punch press according to claim 1 wherein said turret drive means includes independent drives for each of said upper and lower turrets.

5. The punch press according to claim 1 wherein said main press frame and said auxiliary frame are separated from each other in the direction of said Y-axis.

6. A punch press including a punch press frame defining an open space for receiving sheet workpieces, a punch ram at a punching station on said punch press frame, a rotatably mounted upper turret having a perimeter received within said open space of said press frame and a series of punch receiving pockets arrayed about the perimeter thereof, a rotatably mounted lower turret having a perimeter received within said open space of said press frame and a series of die receiving pockets arrayed about the perimeter of the lower turret, said upper turret spaced above said lower turret but of a substantially smaller diameter and having substantially fewer pockets than said lower turret, said upper and lower turrets having offset axes of rotation such that the pockets of each of said upper and lower turrets rotate into alignment beneath said punch ram; and turret drive means for rotating each of said upper and lower turrets to bring any selected pocket to an aligned position beneath said punch ram.

* * * * *

UNITED STATES PATENT AND TRADEMARK OFFICE

CERTIFICATE OF CORRECTION

PATENT NO. : 5,522,295

DATED : June 4, 1996

INVENTOR(S) : Victor L. Chun

It is certified that error appears in the above-identified patent and that said Letters Patent is hereby corrected as shown below:

Column 1, line 55, "requires" should be --require--.

Column 2, line 23, "and," should be --and--.

Column 3, line 13, "to and of a" should be --to a--.

Column 6, line 2, "(not shown)," should be --(not shown)--.

Signed and Sealed this

Twenty-sixth Day of November 1996

*Attest:*

*Attesting Officer*

BRUCE LEHMAN

*Commissioner of Patents and Trademarks*